US005366170A

United States Patent [19]

Jones, Jr. et al.

[11] Patent Number: 5,366,170

[45] Date of Patent: Nov. 22, 1994

[54] VERTICAL SHAFT PROCESSOR INCLUDING AN IMPROVED REMOVAL GRATE

[75] Inventors: John B. Jones, Jr., 12557 E. Kentucky Pl., Aurora, Colo. 80012; Robert V. Zimmerman, Denver, Colo.

[73] Assignee: John B. Jones, Jr., Aurora, Colo.

[21] Appl. No.: 123,376

[22] Filed: Sep. 17, 1993

[51] Int. Cl.[5] ..... B02C 23/02

[52] U.S. Cl. ..... 241/275; 241/282.1

[58] Field of Search ..... 241/199.12, 275, 277, 241/282.1, 282.2; 209/244

[56] References Cited

U.S. PATENT DOCUMENTS 3,027,147 3/1962 Brakel et al. .
3,071,230 1/1963 Brakel et al. .
3,349,930 10/1967 Welborn ..... 241/275 X
3,373,982 3/1968 Jones, Jr. .
3,401,922 9/1968 Jones, Jr. .
3,777,940 12/1973 Jones, Jr. .
3,881,664 5/1975 Bowling, Jr. et al. ..... 241/275
4,817,518 4/1989 Wyatt et al. .
4,921,173 5/1990 Bartley ..... 241/275 X
5,210,962 5/1993 Jones, Jr. .

*Primary Examiner*—Timothy V. Eley
*Attorney, Agent, or Firm*—Gary M. Polumbus

[57] ABSTRACT

A removal grate for a vertical shaft processor includes a distributor plate adapted to receive processed materials and an eccentric distributor wheel for breaking up the processed material and uniformly distributing it across the distributor plate for removal from the processor.

12 Claims, 4 Drawing Sheets

VERTICAL SHAFT PROCESSOR INCLUDING AN IMPROVED REMOVAL GRATE

BACKGROUND OF THE INVENTION

1. Field of the Invention

The present invention relates generally to vertical processing vessels, which are commonly referred to as shaft or vertical kilns, shaft furnaces or shaft generators, depending upon the process for which the vessel is being used, and more particularly, to a removal grate for use in such vessels.

2. Descriptions of the Prior Art

A common form of processing equipment found in diverse industrial applications is a vertical vessel, having a gravity flow of particulate solids from an upper feed to a lower discharge. Commonly, such vessels are called shaft or vertical kilns, shaft furnaces, shaft generators and the like, depending upon the application and particular type of material being treated. Such vessels have been found useful for burning or calcining treatments such as the calcining of various types of materials to produce lime, coking coal, burning magnesite and/or dolomite, retorting oil shale, etc. Such vessels commonly include a vertical vessel shell, means for uniformly feeding granular or pulverulent material across the lateral extent of the vessel, a lower discharge means for providing a uniform discharge of the solid material from the vessel shell and some means for introducing treating fluids into the solids so that the solid material is treated in accordance with the predesigned process. One of the major problems encountered in this type of vessel is the requirements for the uniform flow of solids across the lateral extent of the vessel from its top to its bottom so as to provide uniform treatment of all of the solid particles passing through the vessel.

In order to accommodate the above problem, many such vessels are rectangular in cross-section, as it is easier to uniformly distribute fluids across a four-sided cross-section. Some vessels are circular in cross-section, but it is difficult to control uniform movement of the particulate material through the vessels.

The need to uniformly distribute the particles across the lateral cross-section of the vessel is important due to the fact that the material being processed typically is crushed, and therefore is presented in a variety of sizes, which are fed through the top of the vessel. The particles are typically centrally fed through the top of the vessel, and a certain amount of segregation automatically occurs with the larger particles, usually migrating to the periphery of the vessel, while the smaller particles concentrate near the center of the vessel. This is due to the natural angle of repose of the material as it accumulates in a feed hopper.

There are several features of a vessel that have an effect on the flow patterns of the particulate matter through the vessel, as well as the treating fluids. As mentioned previously, as material is centrally deposited into a vessel, the larger particles tend to migrate radially outwardly at a faster rate than the smaller particles, and accordingly, systems have been developed for introducing the particulate matter to the vessel in a manner to avoid this known phenomenon of segregation. An example of such a system is disclosed in U.S. Pat. No. 3,071,230, issued to Brakel, et al. on Jan. 1, 1963. This patent uniformly distributes the inflowing particulate matter across the lateral cross-section of the vessel to minimize the angle of repose problem.

It will also be appreciated that, if the material is not removed from the bottom of the vessel in a substantially uniform cross-sectional manner, the flow rate of the particulate matter through the vessel will vary across the cross-section of the vessel. Accordingly, systems have been developed and employed for removing the particulate matter from the bottom of the vessel in as uniform a manner as possible, so as to maintain a uniform cross-sectional flow of the particulate matter through the vessel. Examples of such devices for regulating the uniform withdrawal of particulate material from the vessel are shown in my U.S. Pat. Nos. 3,401,922, issued Sep. 17, 1968, and U.S. Pat. No. 3,373,982, issued Mar. 19, 1968, and Brakel, et al.'s U.S. Pat. No. 3,027,147, issued on Mar. 27, 1962. These patents are each directed to grate systems for uniformly removing particulate matter from a cylindrical vessel. Removal grate systems vary to some degree, dependent upon the cross-sectional dimension of the vessel and, for example, a removal grate system disclosed in my U.S. Pat. No. 5,210,962, issued May 18, 1993, was designed primarily for vessels that are greater than seven and one-half feet in diameter.

It is to provide a removal grate system for vessels of relatively small size that the present invention was developed.

SUMMARY OF THE INVENTION

The removal grate of the present invention has been uniquely designed for use in relatively small diameter vertical shaft processors of circular cross-section so that the removal process encourages a substantially uniform cross-sectional flow of material through the vessel.

Relatively small vertical shaft processors typically include a single centrally-disposed discharge opening near the bottom of the vessel through which treated material is removed from the vessel. The removal grate of the present invention is positioned immediately beneath this central discharge opening.

The removal grate includes a distribution plate that is of larger dimension than the central discharge opening, but of smaller dimension than the internal diameter of the shell of the processor. An eccentrically mounted wheel is disposed on top of the distribution plate, in direct alignment with the central discharge opening. The eccentric wheel is rotated about an axis co-axial with the central axis of the discharge opening so as to cyclically distribute material in a circular array around the distribution plate.

Since the particulate material being delivered to the removal grate is many times massed together or aggregated, the eccentric wheel includes cutting blades on an upper surface thereof which separate any aggregated material into a desired particle size for uniform distribution onto the plate and flow through the removal grate. As material on the plate accumulates, it is cyclically urged in a circular pattern radially outwardly by the eccentric wheel and other particulate material on the plate until it drops off an outer periphery of the plate into a ring-shaped discharge opening for removal from the processor through a lock hopper of the type known and used in the industry.

Other aspects, features and details of the present invention can be more completely understood by reference to the following detailed description of a preferred embodiment, taken in conjunction with the drawings, and from the appended claims.

DESCRIPTION OF THE PREFERRED EMBODIMENT

Figure 1:
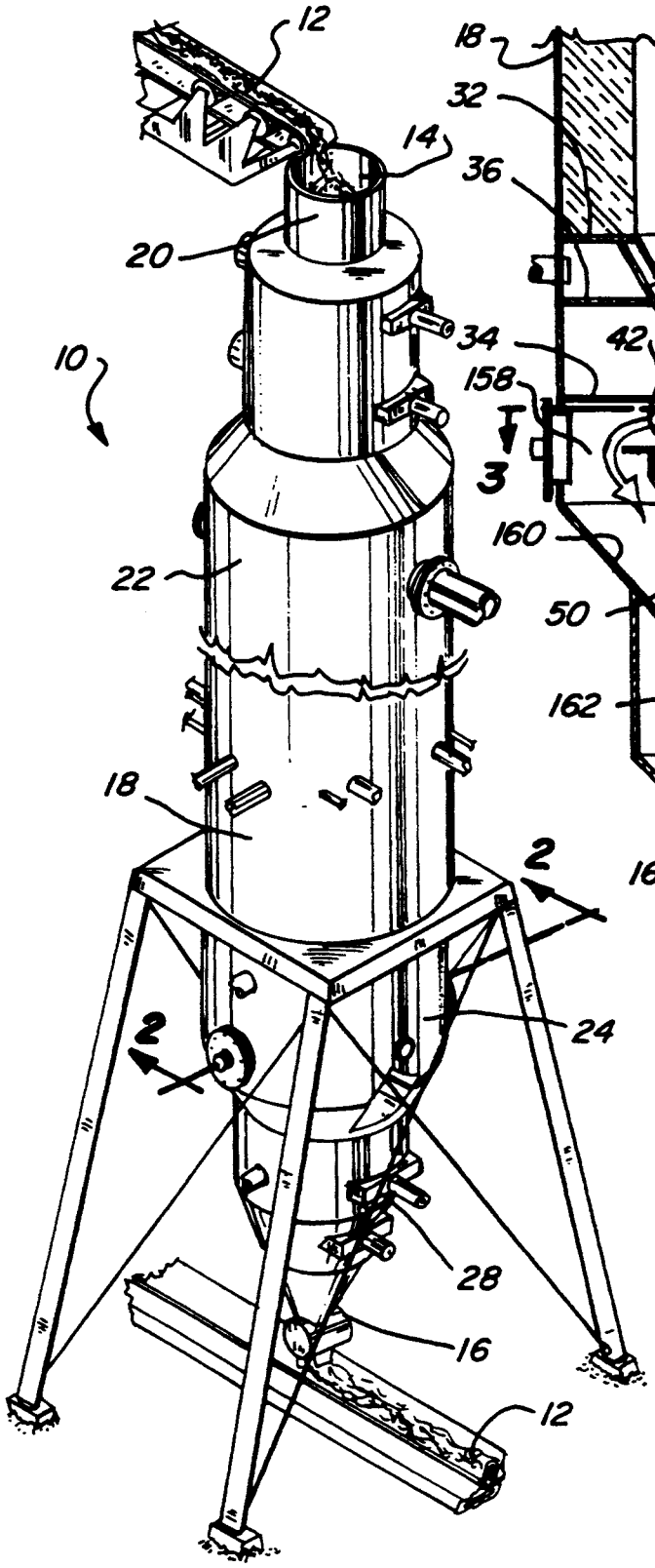
FIG. 1 is an isometric view of a vertical shaft processor incorporating the removal grate of the present invention.

The vertical shaft processor 10 of the present invention, as seen in FIG. 1, finds use in many known fields of endeavor. For purposes of the present disclosure, the various processes which may be practiced with the vessel will not be described in detail. A common feature of these processes, however, resides in the fact that a particulate material 12 to be treated or processed is introduced to the vessel at the top 14 thereof and flows by gravity as a moving bed through the vessel, where it is exposed to a counterflow or concurrent flow of treating fluid before it is removed from the bottom 16 of the vessel. Depending upon the process being practiced within the vessel, the particulate material itself will vary, as will the treating fluids, which may be gas or liquid. Certain gas-treating fluids may be combustible to obtain elevated temperatures in the practice of certain processes.

The processor 10 comprises a vertical and substantially cylindrical wall or shell 18 having an upper feed zone 20, an intermediate treatment zone 22 and a lower removal zone 24. Details of what might exist in the feed and treatment zones can be found in my U.S. Pat. No. 5,210,962, issued May 18, 1993, which is hereby incorporated by reference.

The removal zone 24 includes a removal grate 26, which is designed to remove the material in a substantially uniform manner across the cross-section of the vessel to encourage the uniform flow of particulate matter through the vessel for uniform treatment by the treating fluids. The removal grate in typical vessels may vary, depending to some extent upon the size of the vessel, with larger-diameter vessels possibly utilizing a removal grate of the type disclosed in my aforenoted U.S. Pat. No. 5,210,962. In smaller-diameter vessels, such as vessels having a diameter of less than seven and one-half feet, a removal grate in accordance with the present invention is of particular interest. Subsequent to passing through the removal grate 26, the treated material 12 is removed from the vessel through a lower lock hopper 28, which is disposed beneath the removal grate in the removal zone 24 so that charges or batches of material can be sequentially removed from the vessel without a significant loss of treating fluids. The lower lock hopper 28 is an optional item and may or may not be desired, depending upon the process for which the vessel is being used.

It should be appreciated that the material 12 entering the removal grate 26 may come in various forms, from a small particulate matter to aggregated masses of such particulate matter so that, in order to uniformly remove the material from the vessel, it is important that the removal grate be capable of breaking up any aggregates of such material to render all material substantially uniform in state as it passes through the removal grate.

Figure 2:
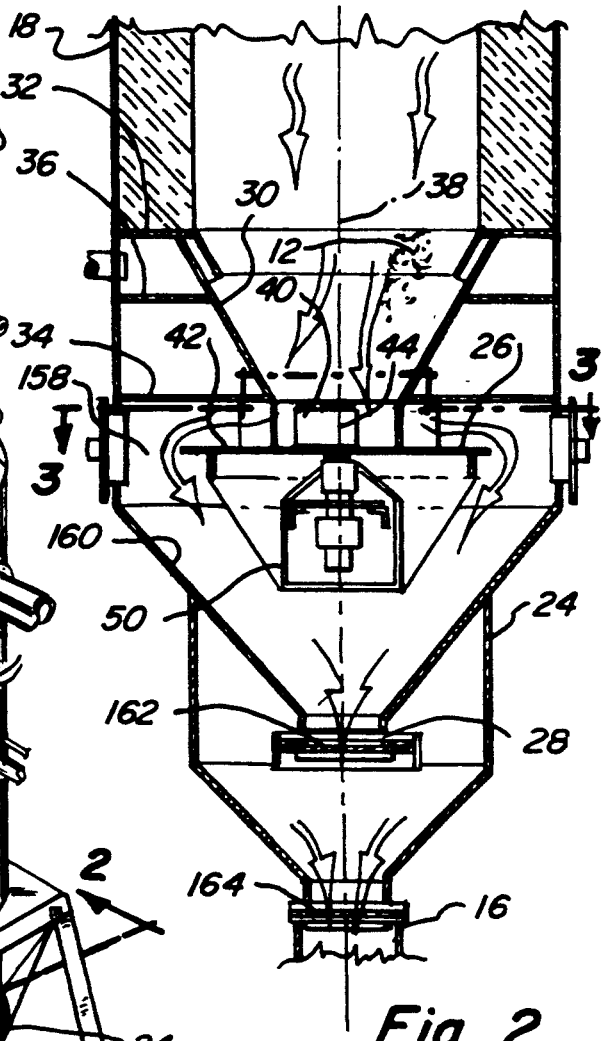
FIG. 2 is an enlarged fragmentary section taken along line 2—2 of FIG. 1.
Figure 3:
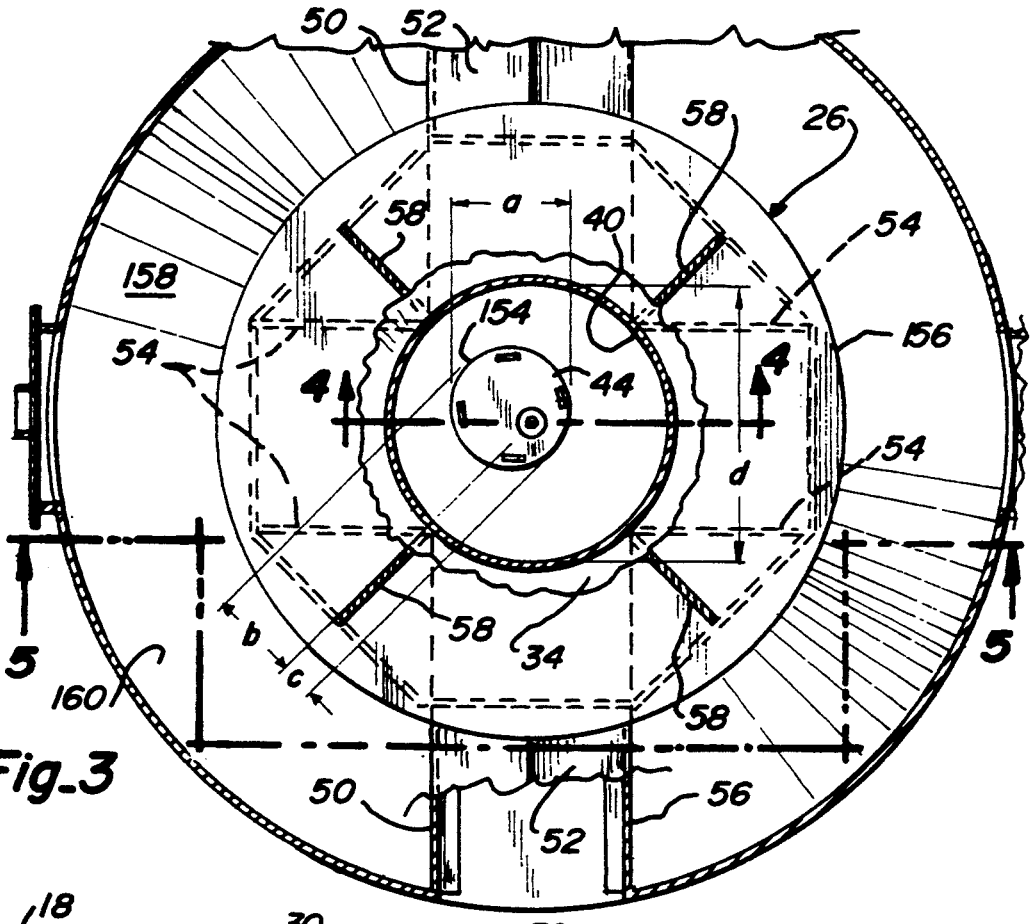
FIG. 3 is a further enlarged horizontal section taken along line 3—3 of FIG. 2.

As best seen in FIG. 2, near the lower end of the relatively small-diameter vertical shaft processor an inverted frustoconical wall or funnel 30 is provided into which the treated material moves by gravity. Of course, the purpose of the funnel is to take a relatively broad cross-section of material and deliver it to the removal grate 26 across a smaller cross-section. The funnel is adequately supported to resist the weight placed thereon, with upper, lower and intermediate horizontal structural members 32, 34 and 36 respectively. The funnel is centered on a central vertical longitudinal axis 38 of the processor, and has a central discharge opening 40 in horizontal alignment with the lower horizontal structural member 34.

The removal grate 26 of the present invention is positioned immediately beneath the central discharge opening 40 and is adapted to break up any agglomerates of material passing through the central discharge opening and distribute the resultant particulate material uniformly across the cross-section of the processor, for ultimate removal through the lower lock hopper 28.

As probably best seen in FIG. 2, the removal grate 26 generally includes a circular horizontal distribution plate 42 of smaller diameter than the internal diameter of the processor shell 18, but of greater diameter than the central discharge opening 40 of the funnel 30. The distribution plate is spaced downwardly from the lower horizontal structural member 34 aligned with the central discharge opening 40 so as to define a space through which the particulate material can be moved onto the distribution plate. A distributor wheel 44 is eccentrically mounted for rotational movement adjacent the top surface of the distribution plate 42 and is positioned in alignment with the central discharge opening 40 to interface with particulate material moving by gravity through the central discharge opening. As will be explained in more detail hereafter, the distributor wheel 44 is mounted on a vertical shaft which is driven by a motor 46 through a reduction unit 48.

Referencing FIGS. 2–7, it can be seen that the distributor plate 42, the distributor wheel 44, the motor 46 and reduction unit 48 are all supported on a structural framework that includes a horizontally disposed channel 50 that is welded or otherwise secured at its opposite ends to the shell 18 at diametrically opposed locations. The channel 50 is of generally square cross-section having an inverted V-shaped top wall 52. The channel extends diametrically across the processor shell immediately beneath the distributor plate 42. Four pair of gussets 54 of generally triangular configuration interconnect side walls 56 of the channel 50 with the undersurface of the distributor plate 42. Four equally-spaced radially-directed vertical distribution veins 58 bridge the space between the distributor plate and the undersurface of the lower horizontal structural member 34. The distribution veins 58 are welded along their upper and lower edges to the lower structural member 34 and the distributor plate 42 respectively. It will thus be appreciated that the distributor plate is strongly supported within the vessel and is reinforced so as to withstand the weight of the particulate matter that is moved thereacross in a manner to be described later.

Figure 5:
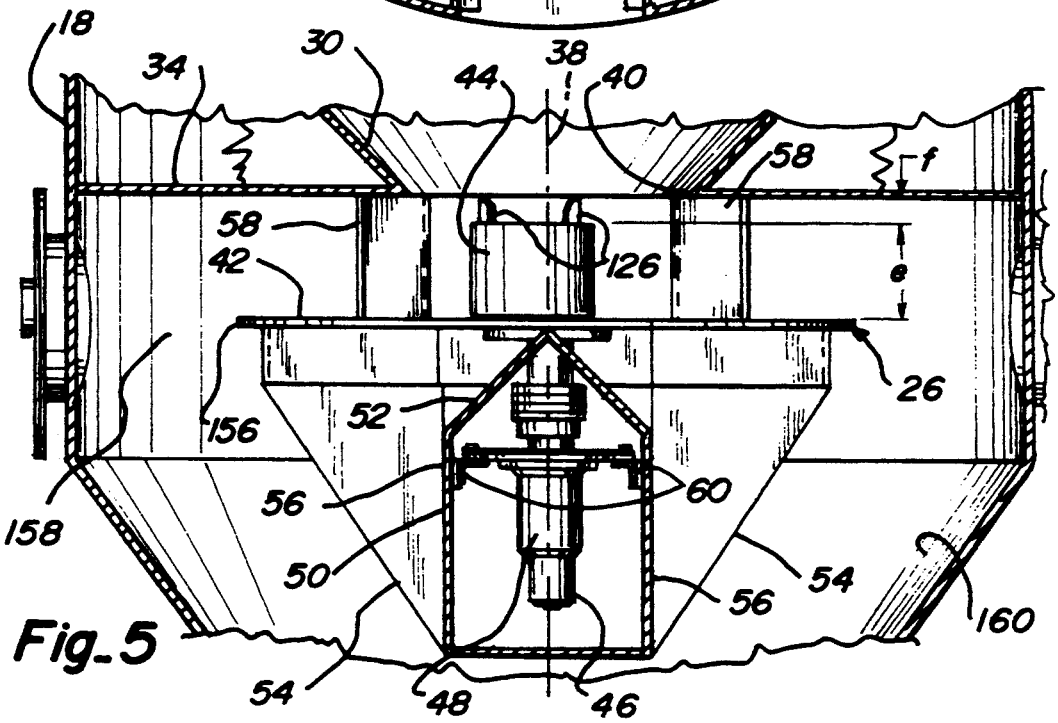
FIG. 5 is a vertical section taken along line 5—5 of FIG. 3.
Figure 4:
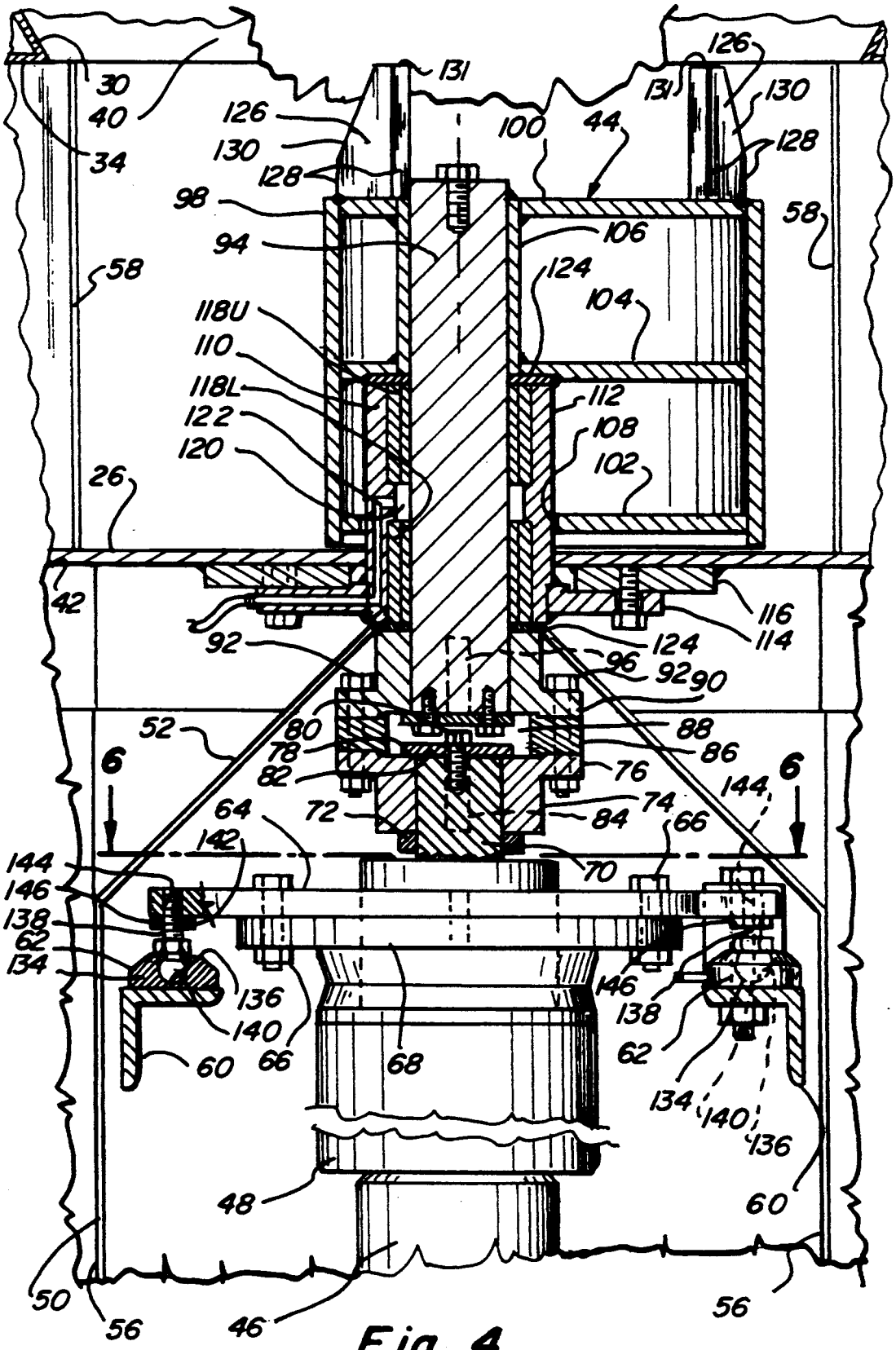
FIG. 4 is an enlarged vertical section taken along line 4—4 of FIG. 3.
Figure 6:
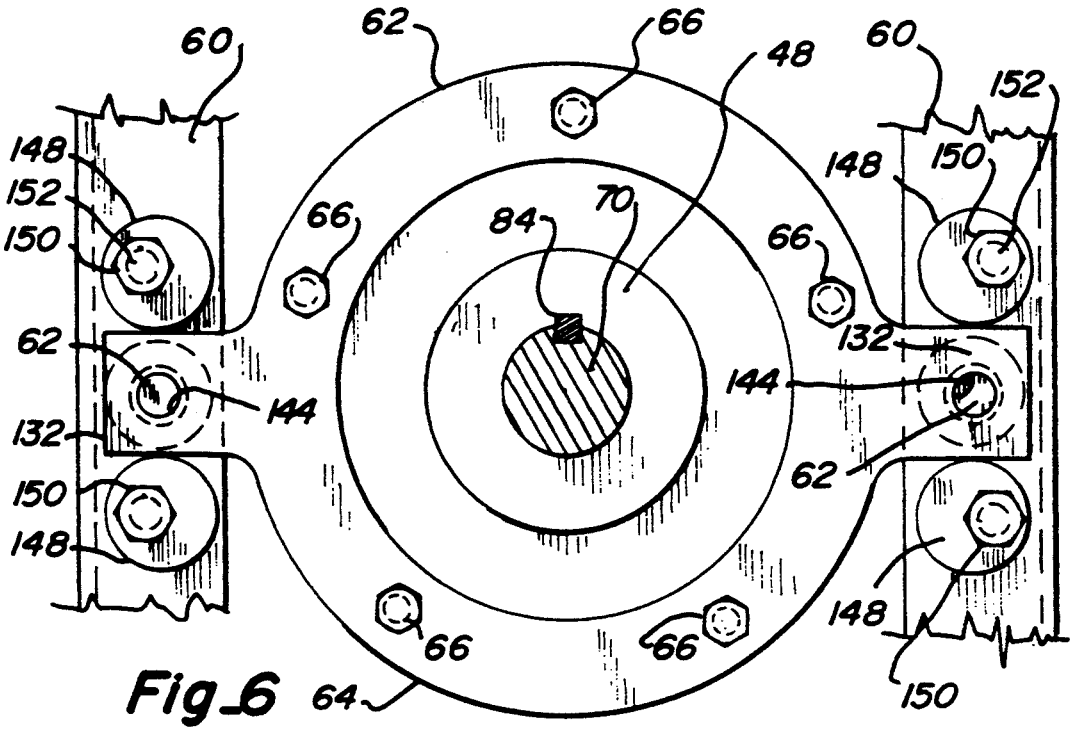
FIG. 6 is a fragmentary horizontal section taken along line 6—6 of FIG. 4.
Figure 7:
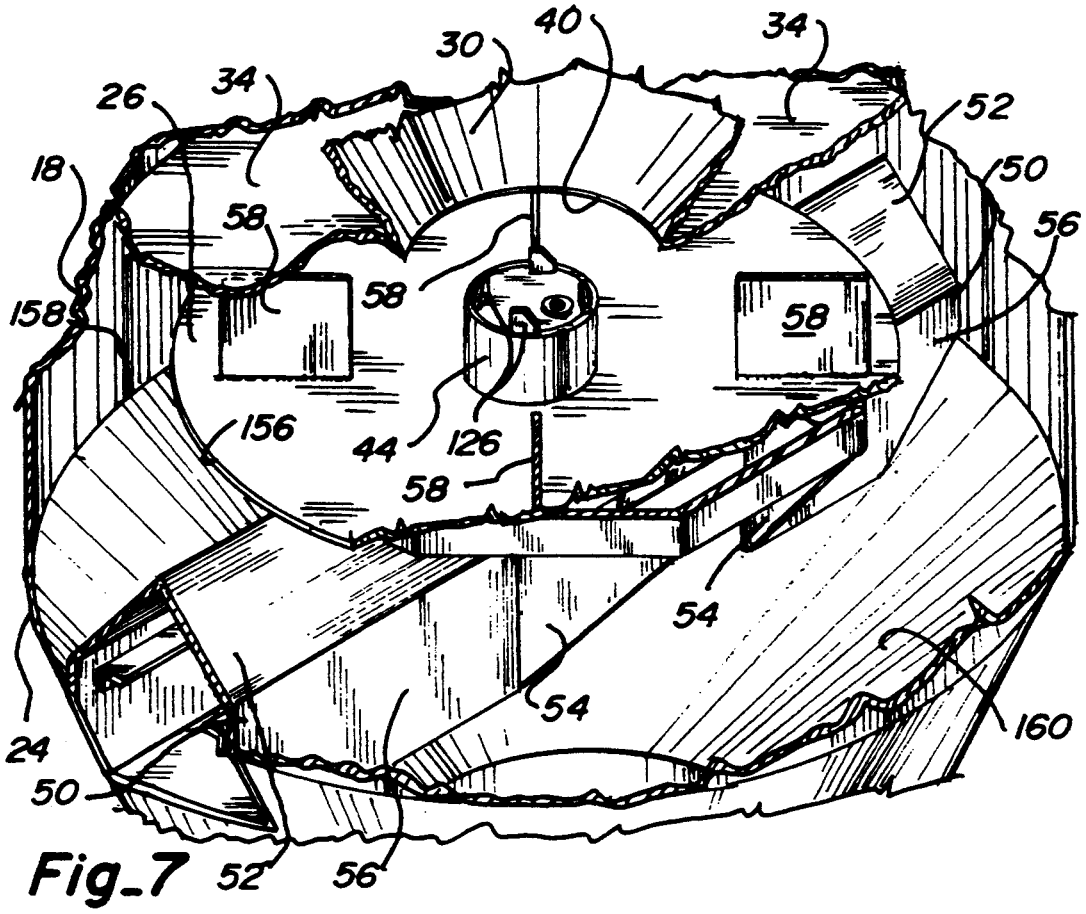
FIG. 7 is a fragmentary isometric view looking down on the removal grate of the present invention.

As probably best seen in FIGS. 4 through 6, a pair of horizontal angle irons 60 are welded or otherwise secured internally to the side walls 56 of the channel 50 and support through an adjustment mechanism 62, shown best in FIGS. 4 and 6, a horizontal generally circular support plate 64. The support plate 64 in turn supports on its lower surface, through fasteners 66, a flange 68 of the reduction unit 48, which is in turn operably and mechanically connected to the upwardly and vertically-extending drive shaft (not shown) of the motor 46.

The reduction unit 48 has an upwardly-extending drive shaft 70 having a flange 72 adjacent to its lower end that supports a lower circular collar 74. The circular collar 74 has a radial flange 76 at its upper end. The distal end 78 of the reduction drive shaft 70 has a threaded hole adapted to receive a fastener 80 that secures a washer 82 across the distal end of the reduction drive shaft, with the washer 82 overlying the collar 74 to retain the collar between the washer 82 and the flange 72 on the reduction drive shaft. The lower collar 74 is also keyed to the reduction drive shaft 70 at 84 in a conventional manner for unitary rotation therewith. A steel spacer ring 86 is positioned on the top surface of the lower collar 74 so as to define an internal chamber 88 in which the washer 82 and fastener 80 are disposed.

An upper collar 90, identical to but inverted relative to the collar 74, is positioned on the spacer ring 86 with both collars 74 and 90 and the spacer ring being interconnected by fasteners 92 passing through the spacer ring and the flanges 76 on the collars. The upper collar 90 receives and circumscribes the lower end of a driven shaft 94, which is coaxial with the drive shaft 70 of the reduction unit 48. The upper collar is keyed to the driven shaft 94 at 96 in a conventional manner so that the driven shaft 94 rotates in unison with both collars 74 and 90 and the drive shaft 70 of the reduction unit.

The distributor or eccentric wheel 44 includes a cylindrical wall 98, an upper circular horizontal wall a lower circular horizontal wall 102 and an intermediate circular horizontal wall 104. A small-diameter vertically-extending cylindrical wall 106 extends between the upper circular wall 100 and the intermediate circular wall 104 and defines a sleeve to receive the upper end of the driven shaft 94. The smaller cylindrical wall 106 is offset from a central axis of the distributor wheel 44, so that when the wheel is mounted on the driven shaft 94, it is, in fact, mounted eccentrically. The lower circular wall of the distributor wheel has a circular opening 108 coaxial with the smaller cylindrical wall 106 to receive a bearing unit 110.

The bearing unit 110 includes a cylindrical bearing housing 112, which is welded to a ring-like horizontal flange 114 at its lower end. The ring-like flange 114 is in turn fastened to a ring-like support flange 116 welded to the undersurface of the distributor plate 42. In this manner, the bearing unit 110 is positively fixed relative to the distributor plate and is co-axial with the driven shaft. The cylindrical bearing housing 112 confines upper and lower sets of cylindrical sleeve bearings 118U and 118L respectively, which circumscribe and guide the driven shaft. The upper and lower sets of sleeve bearings are vertically spaced and define therebetween an open circular channel 120 within the cylindrical bearing. The open circular channel 120 is in turn in communication with an open passageway 122 to a source of pressurized air (not shown) so that any dust-like material that might get inside the bearing unit 110 can be flushed thereout in a known manner with the pressurized air. A pair of thrust bearings 124 are disposed at opposite ends of the cylindrical bearing unit 110 so as to space the cylindrical bearing unit from the upper collar 90 and the intermediate circular wall 104 of the distributor wheel 44. The upper circular wall 100 of the distributor wheel is welded to the driven shaft 94 so that the distributor wheel rotates in unison with the driven shaft.

Four equally spaced cutting blades or teeth 126 are mounted on the top surface of the upper circular wall 100 of the distributor wheel 44 with the blades 126 being of generally plate-like configuration. The blades have a pair of vertically extending edges 128 and an inclined edge 130 interconnecting the vertical edges through a short horizontal edge 131. The blades are positioned on and equally spaced along a circular line (not shown) spaced immediately inwardly from the outer periphery of the distributor wheel 44. The inclined edges 130 of the blades are all positioned on the leading edges of the blades as determined by the direction of rotation of the eccentric distributor wheel.

The blades 126 are intended to break up any agglomerations of particulate material that are fed to the removal grate 26 so that the particulate material is freely flowable through the removal grate for ultimate removal from the vessel through the lower lock hopper 28.

The generally circular support plate 64 secured to the flange 68 of the reduction unit 48, as best seen in FIGS. 4 and 6, has diametrically opposed and radially directed arms 132 which are fastened to the adjustment mechanisms supported on the angle irons 60. The adjustment mechanisms include a base 134 having a generally semi-spherical upwardly opening cup 136 therein which supports a substantially vertically extending pin 138. The pin has a spherical head 140 on its lower end and a threaded shaft 142 extending upwardly. The threaded shaft 142 is threaded into an aligned threaded opening 144 in one of the diametrically opposed arms 132 of the support plate 64 and a pair of adjustment nuts 146 are positioned on the threaded shaft between the spherical head 140 and the support plate. As will be appreciated, the elevation of the support plate can be adjusted by moving the nuts 146 relative to each other and advancing or retracting the threaded shaft 142 relative to the support plate. The nuts can then be threadedly separated to lock the position of the plate relative to the pins. As best seen in FIG. 6, a pair of eccentric, selectively pivotally adjustable discs 148 are mounted on the angle irons 60 adjacent to the base 134 and are secured in a desired position with nuts 150 threaded onto the upper end of pivot shafts 152. As will be appreciated, by loosening the nuts and pivoting the eccentric discs 148, the position of the diametrically opposed arms 132 can be shifted in a horizontal direction through pivotal movement of the pins 138 about their spherical heads. Horizontal movement of the support plate 64 laterally shifts the drive shaft 70 of the reduction unit 48.

The adjustable mounting of the support plate 64 of course is to allow the reduction drive shaft 70 to be properly aligned with the driven shaft 94 of the eccentric wheel 44 for connection of the two shafts via the upper and lower collars 90 and 74 respectively and the spacer ring 86.

The operation of the removal grate 26 will be evident from the above noted description but as will be appreciated, the eccentric wheel 44 is rotated about the driven shaft 94 to which it is connected. The shaft 94, as mentioned previously, is aligned with the center of the central discharge opening 40 of the funnel 30. The location 154 (FIGS. 3, 4 and 7) on the cylindrical wall 98 of the eccentric wheel that is maximally spaced or removed from the driven shaft 94 moves in a circle when rotated about the driven shaft which is slightly smaller than the diameter of the central discharge opening. It should also be appreciated that the upper surface 100 of the eccentric distributor wheel is spaced a very small distance below the central discharge opening of the funnel and thus a space is provided through which particulate material can pass and be shoved radially outwardly across the distributor plate 42 by the cylindrical wall 98 during rotation of the eccentric wheel. The eccentric wheel thus progressively pushes the particulate material in a circular pattern radially outwardly as the wheel eccentrically rotates about the central axis of the driven shaft so that particulate material is progressively pushed off the circumferential edge 156 of the distributor plate 42 in correspondence with the rotation of the eccentric distributor wheel.

Particulate material drops off the distributor plate 42 into a ring shaped discharge opening 158 and is received on a lower funnel surface 160 of the processor from which the material is channeled into an upper gate 162 of the lower lock hopper 28 which opens and closes in sequence with a lower gate 164 of the lock hopper positioned there beneath to remove particulate matter from the vessel without losing treating gases in a manner described in more detail in my aforenoted U.S. Pat. No. 5,210,962.

It has been discovered that the size and eccentric mounting of the distributor wheel relative to the central discharge opening has a significant effect on the ability of the removal grate to maintain a uniform cross-sectional flow of particulate material through the vessel.

By way of example, the following parameters have been found to provide optimum results as far as encouraging a uniform cross-section flow of material:

distributor wheel dia. a=15 3/8"

distance b from central axis of the driven shaft to point 154 on distributor wheel maximally spaced from central axis=10½"

distance c from central axis of the driven shaft to a point on the distributor wheel diametrically opposite point 154 that is minimally spaced from the central axis=4½"

diameter d of central discharge opening=30"

height of distributor wheel=12"

distance f from top of distributor wheel to horizontal plane of central discharge opening =3"

Although the present invention has been described with a certain degree of particularity, it is understood that the present disclosure has been made by way of example, and changes in detail or structure may be made without departing from the spirit of the invention, as defined in the appended claims.

We claim:

1. A vertical shaft processor comprising in combination a substantially cylindrical shell having a vertical longitudinal axis and an inner wall, processing means in said shell for treating materials that flow by gravity through said shell, a funnel shaped wall adjacent to the lower end of said shell defining a central discharge opening, and removal grate means beneath said discharge opening, said removal grate means including a substantially horizontal plate having an outer periphery spaced from said inner wall of the shell to define a discharge opening between said outer periphery and said inner wall, and an eccentric distributor wheel positioned on said plate in alignment with said central discharge opening, said distributor wheel being mounted for eccentric rotation to urge material delivered thereto from said central discharge opening to said discharge opening.

2. The processor of claim 1 wherein said central discharge opening is co-axial with said longitudinal axis and said distributor wheel is eccentrically rotated about said longitudinal axis.

3. The processor of claim 2 wherein said discharge opening is concentric with said longitudinal axis.

4. The processor of claim 2 wherein said distributor wheel has an upper surface and includes at least one cutting blade on said upper surface.

5. The processor of claim 4 wherein said cutting blade projects vertically upwardly from said upper surface.

6. The processor of claim 5 wherein said eccentric wheel is rotated in one direction and said blade has a leading edge and a trailing edge relative to said direction of rotation, said leading edge being inclined relative to vertical.

7. The processor of claim 6 wherein said cutting blade is planar in configuration, moves along a line of rotation and has its plane being substantially aligned with said line of rotation.

8. The processor of claim 4 wherein said distributor wheel comprises a cylinder having a closed upper end defining the upper surface of the distributor wheel.

9. The processor of claim 8 wherein said upper surface is horizontal.

10. The processor of claim 9 wherein said cylinder is a circular cylinder.

11. The processor of claim 10 further including motor means mounted beneath said horizontal plate and a vertical drive shaft operably connected to said motor means, said drive shaft protruding upwardly through said horizontal plate and wherein said distributor wheel is eccentrically mounted on said drive shaft for unitary rotation therewith.

12. The processor of claim 9 wherein said distributor wheel is of smaller horizontal dimension than said central discharge opening and said upper surface of said distributor wheel is substantially horizontally aligned with said central discharge opening.

* * * * *